US005797721A

United States Patent [19]

Yu

[11] Patent Number: 5,797,721

[45] Date of Patent: Aug. 25, 1998

[54] CEILING FAN HOUSING HAVING LIGHT DEVICE

[76] Inventor: Jack Yu, No. 109-1, Avenue 6, Lane 164, Tzong Sa Road, Da Du Hsiang, Taichung Hsien, Taiwan

[21] Appl. No.: 843,679

[22] Filed: Apr. 10, 1997

[51] Int. Cl.[6] ..... F04D 29/00

[52] U.S. Cl. ..... 415/5; 362/147; 362/363; 362/404

[58] Field of Search ..... 416/5; 362/147, 362/363, 367, 404, 453

[56] References Cited

U.S. PATENT DOCUMENTS

| | | | |
|---|---|---|---|
| 5,441,387 | 8/1995 | Yu | 416/5 |
| 5,503,524 | 4/1996 | Yu | 416/5 |
| 5,568,969 | 10/1996 | Yu | 362/404 |
| 5,653,532 | 8/1997 | Chan | 362/453 |
| 5,655,877 | 8/1997 | Yu | 416/5 |
| 5,672,048 | 9/1997 | Yu | 416/5 |

*Primary Examiner*—John T. Kwon

[57] ABSTRACT

A ceiling fan housing includes a housing member having one or more openings. A disc is secured on the housing member and includes one or more lamp holders secured to the bottom for holding light bulb and for engaging the lamp holders into the housing member via the openings. A lamp shade is secured to the bottom portion of the housing member. The disc includes a circular bulge for forming an annular channel and for receiving electric wire. A sealing ring is engaged between the housing member and the lamp shade for forming as a shock absorbing member.

3 Claims, 3 Drawing Sheets

CEILING FAN HOUSING HAVING LIGHT DEVICE

BACKGROUND OF THE INVENTION

1. Field of the Invention

The present invention relates to a ceiling fan, and more particularly to a ceiling fan housing having a light device.

2. Description of the Prior Art

Typical ceiling fan housings are provided for receiving motor and are made of metal material such that the ceiling fan housings may not be use as lamp shade and such that lights or lamps may not be engaged in the ceiling fan housing.

The present invention has arisen to mitigate and/or obviate the afore-described disadvantages of the conventional ceiling fan housings.

SUMMARY OF THE INVENTION

The primary objective of the present invention is to provide a ceiling fan housing which includes one or more lamps that may be easily engaged into the ceiling fan housing.

In accordance with one aspect of the invention, there is provided a ceiling fan housing comprising a body including at least one opening and including a bottom portion, a disc secured on the body, at least one lamp holder secured to the disc for holding light bulb and for engaging into the body via the at least one opening, and a lamp shade including an upper portion secured to the bottom portion of the body. The at least one lamp holder is allowed to engage into the body via the opening and is allowed to be disengaged from the body.

The disc includes a circular bulge for defining an annular channel and for receiving electric wire.

A sealing ring is engaged between the body and the lamp shade and includes an upper peripheral groove for engaging with the bottom portion of the body and includes a lower peripheral groove for engaging with the upper portion of the lamp shade.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
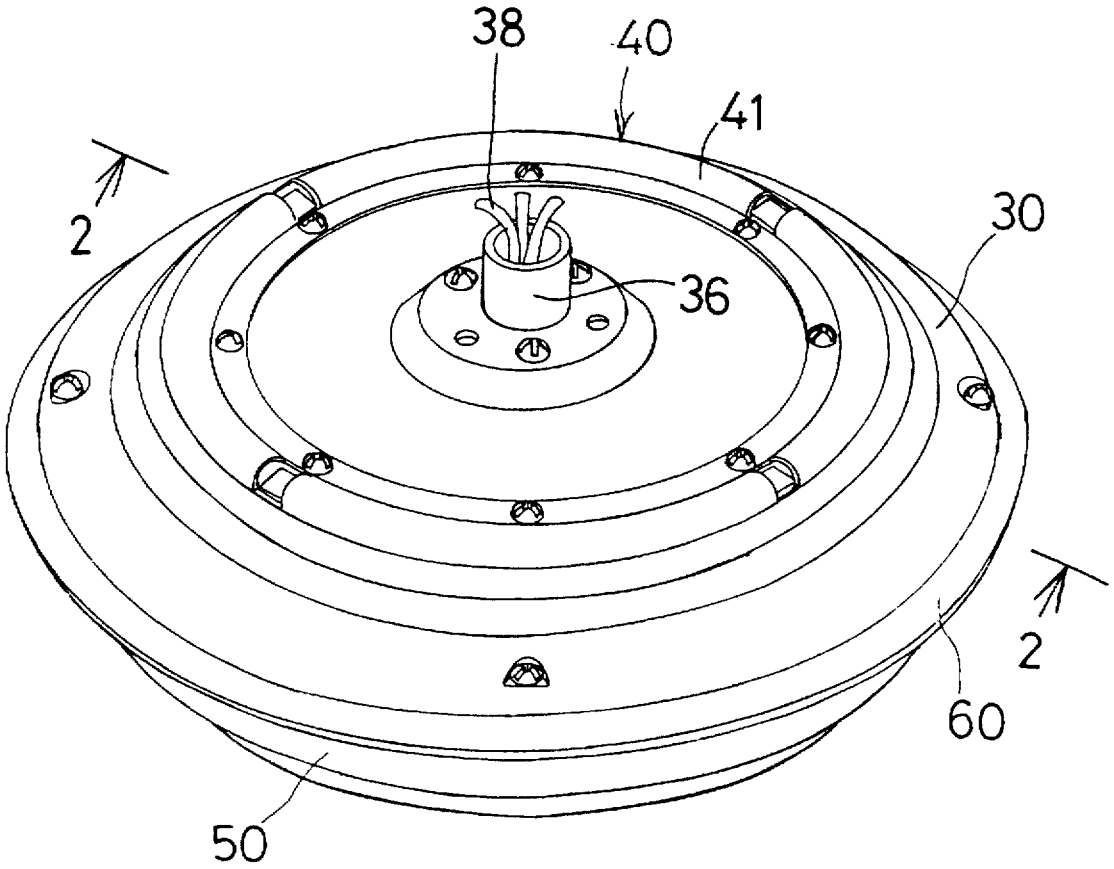
FIG. 1 is a perspective view of a ceiling fan housing in accordance with the present invention.
Figure 2:
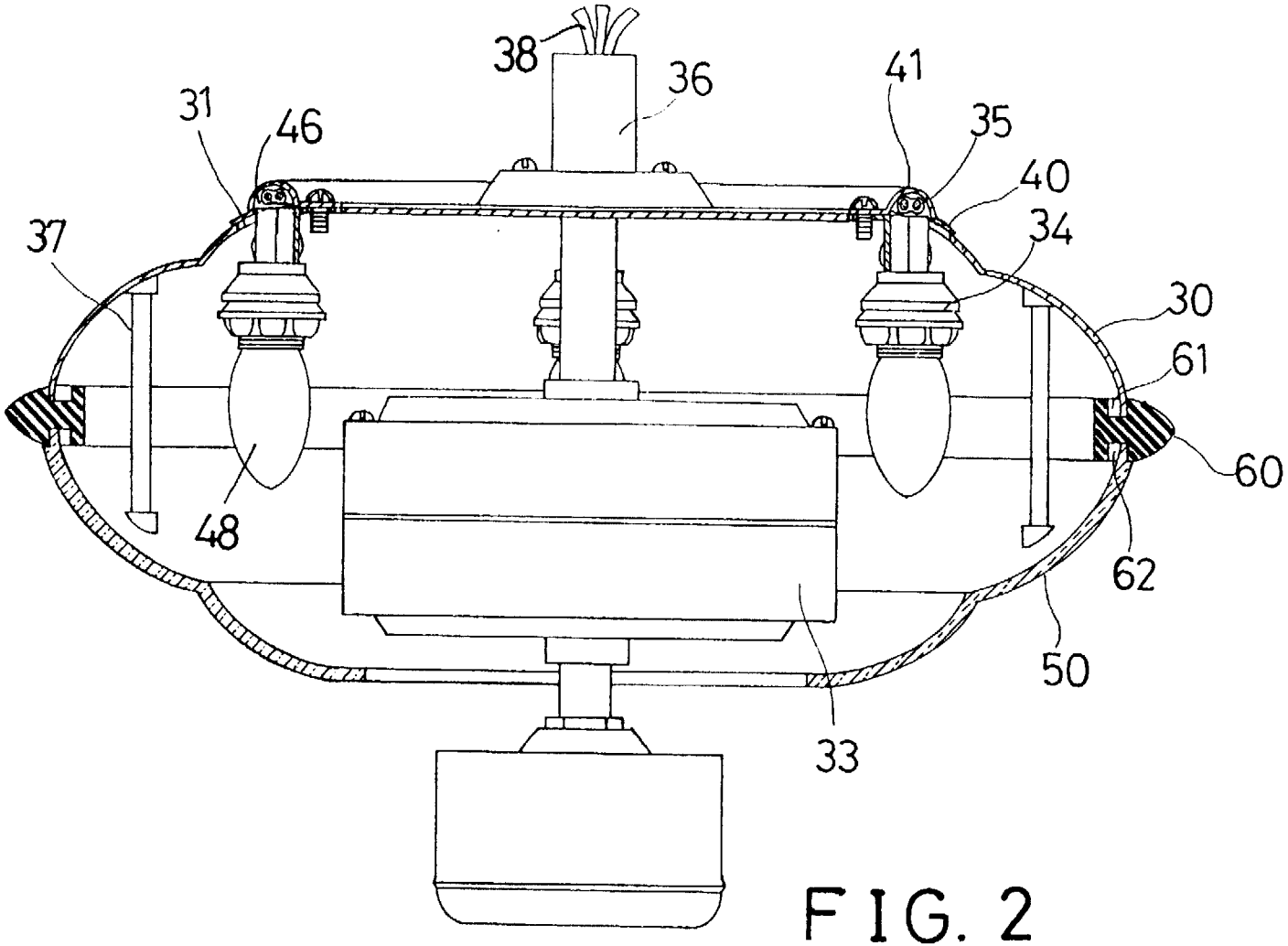
FIG. 2 is a cross sectional view taken along lines 2—2 of FIG. 1.
Figure 3:
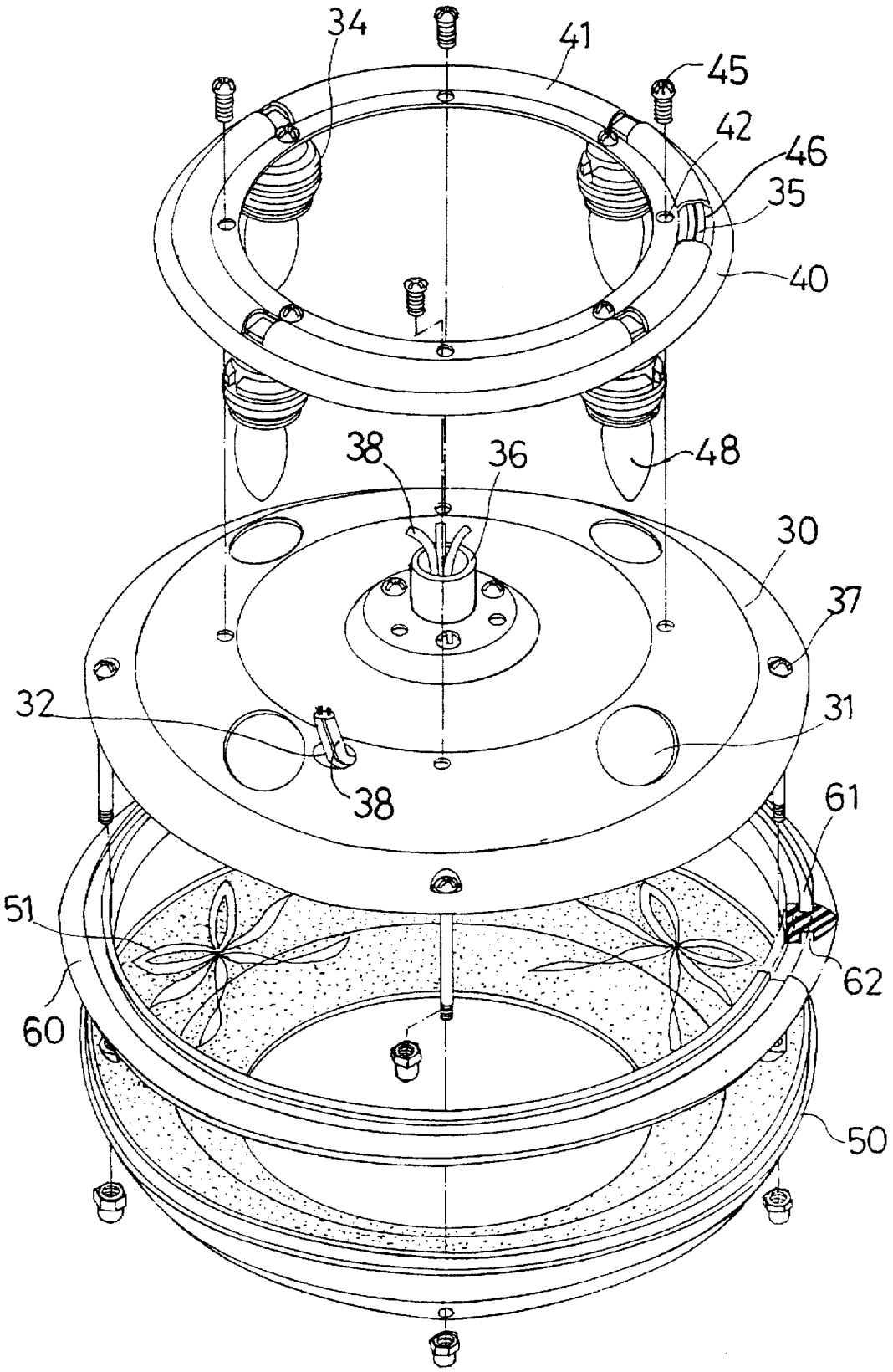
FIG. 3 is an exploded view of the ceiling fan housing.

Referring to the drawings, a ceiling fan housing in accordance with the present invention comprises a body 30 including one or more openings 31 and including a hole 32 for engaging with electric wire 38 and including a number of fastener bolts 37 engaged in the peripheral portion. The body 30 includes a tube 36 disposed in the center portion for engaging with electric wire 38.

A disc 40 includes a number of holes 42 for engaging with fasteners 45 which may secure the disc 40 to the body 30. The disc 40 includes a circular bulge 41 for forming an annular channel 46 and for receiving electric wire 35. One or more lamp holders 34 are secured to the bottom of the disc 40 for holding light bulbs 48. The lamp holders 34 and the light bulbs 38 may be easily engaged into the body 30 via the openings 31 without interfering the assembling of the ceiling fan motor 33. The disc 40 and the body 30 may be made to different shapes, such as square, pentagon, hexagon, etc. The electric wire 35 for coupling to the light bulbs 48 may be suitably retained in the channel 46 and may be coupled to the electric wire 38 for motor 33 from outside of the body 30.

A sealing ring 60 includes an upper peripheral groove 61 for engaging with the bottom peripheral portion of the body 30 and includes a lower peripheral groove 62 for engaging with the upper peripheral portion of a lamp shade 50 such that the sealing ring 60 may be formed as a shock absorbing member. The lamp shade 50 is preferably made of transparent material having one or more patterns 51 provided or painted or attached thereon. The fastener bolts 37 may secure the lamp shade 50 to the body 30.

Accordingly, the ceiling fan housing in accordance with the present invention includes one or more lamps that may be easily engaged into the ceiling fan housing and that will not affect the assembling of the ceiling fan motor.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ceiling fan housing comprising:

a body including at least one opening and including a bottom portion, a disc secured on said body, at least one lamp holder secured to said disc for holding light bulb and for engaging into said body via said at least one opening, and a lamp shade including an upper portion secured to said bottom portion of said body, said at least one lamp holder being allowed to engage into said body via said opening and being allowed to be disengaged from said body.

2. A ceiling fan housing according to claim 1, wherein said disc includes a circular bulge for defining an annular channel and for receiving electric wire.

3. A ceiling fan housing according to claim 1 further comprising a sealing ring engaged between said body and said lamp shade, said sealing ring including an upper peripheral groove for engaging with said bottom portion of said body and including a lower peripheral groove for engaging with said upper portion of said lamp shade and for allowing said sealing ring to form a shock absorbing means between said body and said lamp shade.

* * * * *